US011009221B1

(12) United States Patent
Zeitler et al.

(10) Patent No.: US 11,009,221 B1
(45) Date of Patent: May 18, 2021

(54) TORCH POLE WITH EASE OF INSTALLATION FEATURES

(71) Applicant: Lamplight Farms Incorporated, Menomonee Falls, WI (US)

(72) Inventors: Lucas Henry Zeitler, Wauwatosa, WI (US); Samantha Wisniewski, Walworth County, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 0 days.

(21) Appl. No.: 16/864,943

(22) Filed: May 1, 2020

(51) Int. Cl.

| | |
|---|---|
| ***F21L 17/00*** | (2006.01) |
| ***F21V 21/08*** | (2006.01) |
| ***F21V 21/104*** | (2006.01) |
| ***E04H 12/20*** | (2006.01) |

(52) U.S. Cl.
CPC ..... *F21V 21/0824* (2013.01); *E04H 12/20* (2013.01); *F21V 21/104* (2013.01)

(58) Field of Classification Search
None
See application file for complete search history.

(56) References Cited

U.S. PATENT DOCUMENTS

| | | | | |
|---|---|---|---|---|
| 5,349,158 | A * | 9/1994 | Mari | B23K 9/285 219/137.62 |
| 5,547,371 | A * | 8/1996 | Rose | F23D 3/18 362/161 |
| 2011/0299272 | A1* | 12/2011 | Ko | F21V 15/01 362/183 |
| 2012/0020061 | A1* | 1/2012 | Schefers | F21V 21/12 362/183 |
| 2018/0073709 | A1* | 3/2018 | Enck, Sr. | F21V 21/06 |
| 2019/0137677 | A1* | 5/2019 | Cox | G02B 6/0006 |

* cited by examiner

*Primary Examiner* — Elmito Breval
(74) *Attorney, Agent, or Firm* — David G. Woodral; GableGotwals

(57) ABSTRACT

A torch pole assembly including a torch pole having a top, a bottom, and a length between the top and bottom. An opening passes through the torch pole transverse to its length. A step comprises a pair of spaced apart sidewalls, each defining a sidewall opening situated on the common axis, and a floor spanning between the sidewalls and spaced apart from the sidewall openings. An axle occupies the common axis and passes through the pair of sidewall openings and the torch pole opening. The step is rotatable from a parallel position to a perpendicular position in which the floor is perpendicular to the length of the torch pole, the step floor defining a cutout proximate the collar that receives and contacts the collar when the step is in the perpendicular position thereby preventing the step from rotation beyond the perpendicular position.

21 Claims, 10 Drawing Sheets

TORCH POLE WITH EASE OF INSTALLATION FEATURES

FIELD OF THE INVENTION

The present disclosure relates to outdoor torches in general and, more particularly, to outdoor torch poles.

BACKGROUND OF THE INVENTION

Outdoor torches are used for a variety of decorative and utilitarian purposes. In addition to providing useful or decorative lighting they may also be used to disperse scents or insect repellants. This is true whether the outdoor torch is a liquid fuel burning torch, electrically powered, or otherwise. While some torches are intended for tabletop use, or to be placed directly on the ground or another stable surface, in some instances the light, appearance, and utility of an outdoor torch may be enhanced by mounting or displaying the torch on a pole providing some degree of elevation. Securely anchoring a torch pole into the ground can be difficult due to the hardness of the ground, difficulty in obtaining sufficient purchase on the pole, or for a variety of other reasons.

What is needed is a system and method for addressing the above and related issues.

SUMMARY OF THE INVENTION

The invention of the present disclosure, in one aspect thereof, comprises a torch pole assembly having a torch pole with a top, a bottom, and a length between the top and bottom. An opening passes through the torch pole transverse to its length. A collar receives the torch pole and having a pair of collar openings on opposite sides of the collar and arranged to be on a common axis with the opening through the torch pole. A step comprises a pair of spaced apart sidewalls, each defining a sidewall opening situated on the common axis, and a floor spanning between the sidewalls and spaced apart from the sidewall openings. An axle occupies the common axis and passes through the pair of sidewall openings, the pair of collar openings, and the torch pole opening. The step is rotatable from a parallel position in which the floor is parallel to the length of the torch pole, to a perpendicular position in which the floor is perpendicular to the length of the torch pole, the step floor defining a cutout proximate the collar that receives and contacts the collar when the step is in the perpendicular position thereby preventing the step from rotation beyond the perpendicular position.

In some embodiments, the floor of the step is at a bottom of the spaced apart sidewalls when the step is in the perpendicular position. The spaced apart sidewalls may provide widened upper edges opposite the floor that have a width greater than a width of the spaced apart sidewalls where each joins the floor.

The torch pole may be received into a channel defined by the spaced apart walls and the floor when the step is in the parallel position. The step may be proximate the bottom of the torch pole and spaced apart from the top of the torch pole. The torch pole may provide a pointed end and may comprise multiple pole segments. The torch pole may be hollow. The axle may comprise a rivet. The axle may be removable.

The invention of the present disclosure, in another aspect thereof, comprises a torch pole assembly including a torch pole having a top, a bottom, and a length between the top and bottom. An opening passes through the torch pole transverse to its length. A step comprises a pair of spaced apart sidewalls, each defining a sidewall opening situated on the common axis, and a floor spanning between the sidewalls and spaced apart from the sidewall openings. An axle occupies the common axis and passes through the pair of sidewall openings and the torch pole opening. The step is rotatable from a parallel position in which the floor is parallel to the length of the torch pole, to a perpendicular position in which the floor is perpendicular to the length of the torch pole, the step floor defining a cutout proximate the collar that receives and contacts the collar when the step is in the perpendicular position thereby preventing the step from rotation beyond the perpendicular position.

In some embodiments, floor cutout comprises an arc of a circle. The torch may further comprise a collar receiving the torch pole and interposing the torch pole and the step, and further having a pair of collar openings on opposite sides of the collar and arranged to be on a common axis with the opening through the torch pole. The floor of the step may be positioned along a bottom of the pair of spaced apart sidewalls when the step is in the perpendicular position and each of the pair of spaced apart sidewalls terminates in a widened edge at the top thereof, opposite the floor. In some cases, the step is proximate the bottom of the torch pole and spaced apart from the top of the torch pole and defines an anchor portion of the pole between the step and the bottom of the torch pole. The anchor portion may terminate in a pointed end at the bottom of the torch pole. In some cases, the torch assembly further comprises a mount for receiving a torch at the top of the torch pole.

The invention of the present disclosure, in another aspect thereof, comprise a torch pole assembly including a pole having an upper end, a bottom end, and a length therebetween, and a step having a channel defined between a pair of sidewalls and bounded on a bottom side by a floor spanning between the sidewalls. The step is affixed with respect to the pole on an axis and is moveable on the axis from a first position in which the pole is within the channel and a second position in which the floor is at a right angle to the pole and prevents further movement of the step on the axis.

In some embodiments, the torch pole assembly further comprises a collar received onto the pole at a location of the axis, the collar interposing the axis and the floor of the step when the step is in the second position. The pole and the axle may form a pair of nested cylinders at the location of the axis. The floor may receive the collar into a radiused cutout when the step is in the second position. In some embodiments, the torch pole assembly further comprises a sleeve that receives the torch pole and affixes the step in position with respect to the pole.

DETAILED DESCRIPTION OF THE PREFERRED EMBODIMENTS

Figure 1:
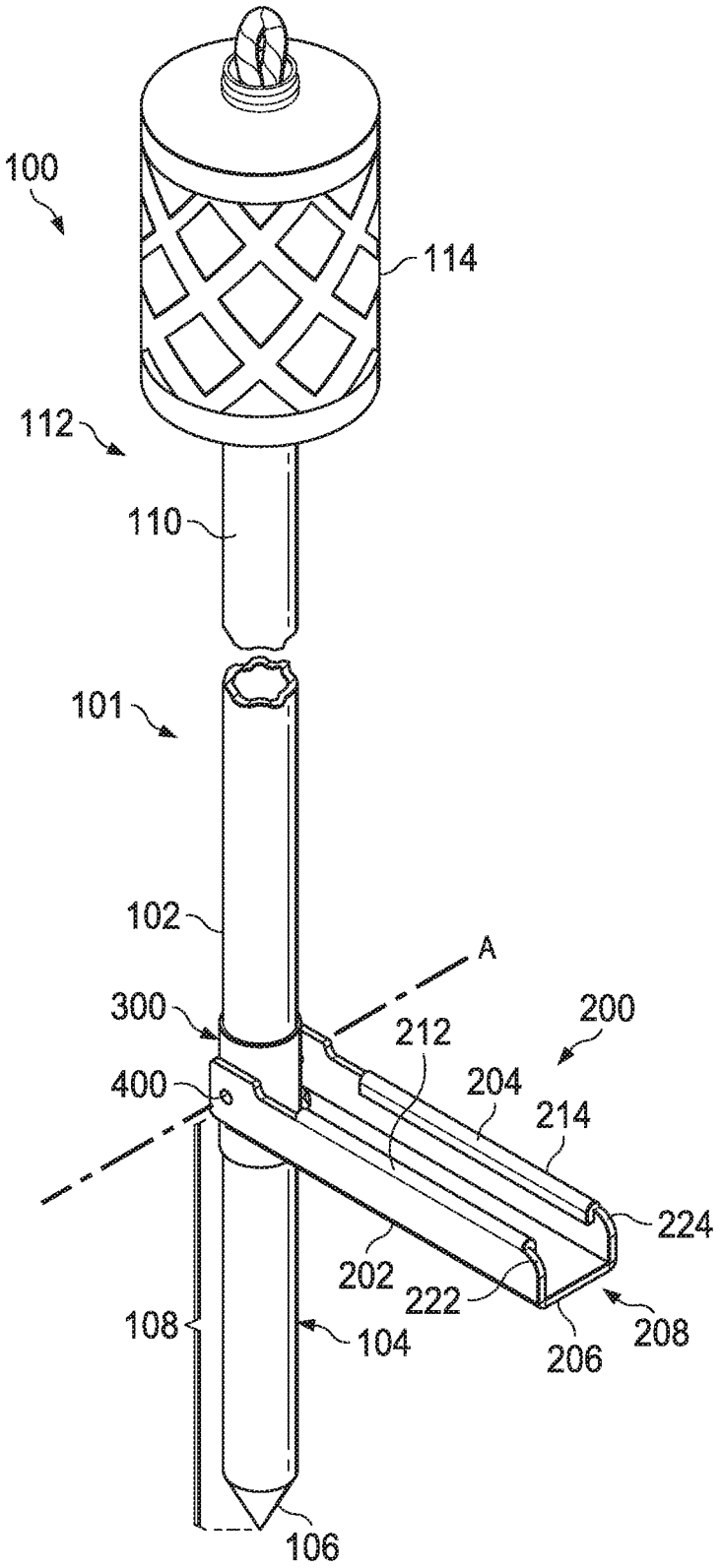
FIG. 1 is a perspective view of a torch pole system according to aspects of the present disclosure.
Figure 2:
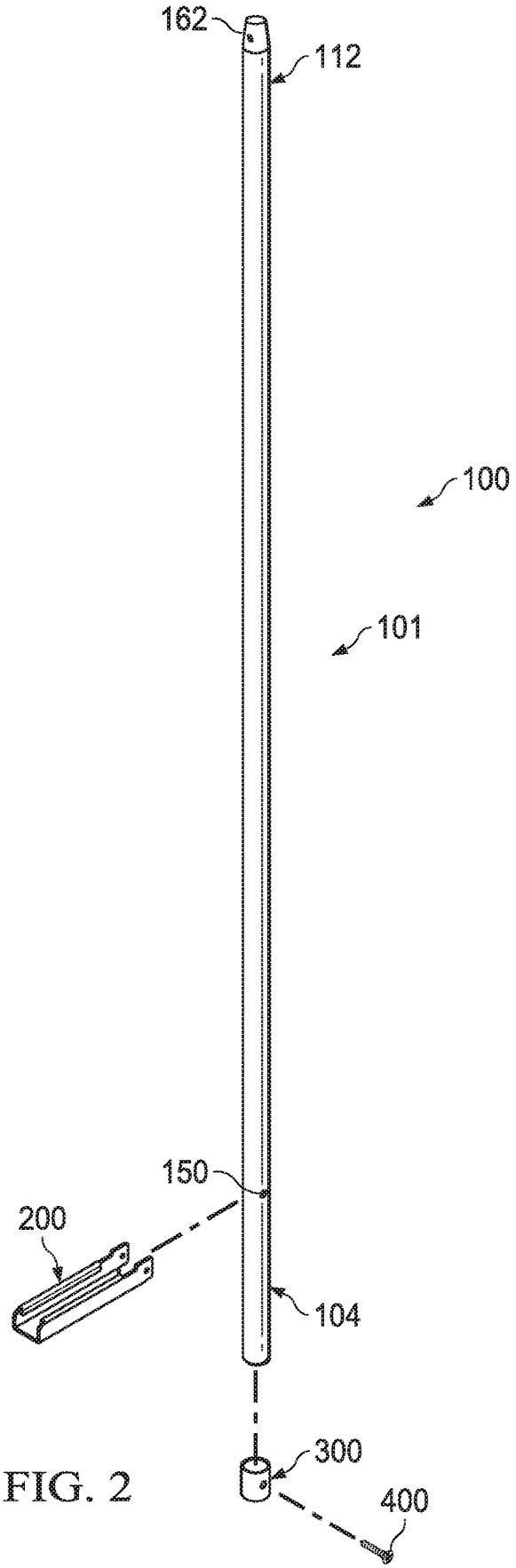
FIG. 2 is an exploded perspective for of the torch pole system of FIG. 1.

Referring now to FIG. 1, is a perspective view of a torch pole system 100 according to aspects of the present disclosure is shown. The system 100 includes a torch pole 101, which may be generally tubular or cylindrical in shape. The torch pole 101 may be formed in a hollow configuration and may be made from rolled sheet metal or another suitable material. it may be painted or otherwise treated to resist weathering. In other embodiments, the torch pole 101 may comprise wooden elements or polymers, or may have a composite construction. In some embodiments the torch pole 101 has a unitary construction, in other words, it is a single integrated component. However, the torch pole 101 may comprise separate segments that are detachable, possibly being selectively detachable by a user with or without tools. As illustrated in FIG. 2, the torch pole 101 comprises a lower pole segment 102 and an upper pole segment 110.

Whether the torch pole 101 comprises multiple segments (e.g., 102, 110) or is a monolithic component, it may be considered as having a bottom 104 and a top 112 and a length between them. The length corresponds to the major axis of the torch pole 101. The bottom 104 of the torch pole 104 may be anchored into the ground or another stable surface while the top 112 provides a mounting location for a torch 114 or another item in an elevated position relative to the ground.

The bottom 104 of the torch 108 comprises an anchor portion 108 of the torch pole 101. In various embodiments, the anchor portion 108 is a length of the torch pole 101 that may be partially or completely inserted into or anchored into the ground. A tip 106 may be provided at the end of the bottom 104 of the torch pole 101. The tip 106 may be conic or chiseled to aid in the insertion of the anchor portion 108 into the ground.

In some embodiments, the anchor portion 108 may be delimited by the tip 106, or very end of the bottom 104 of the torch pole 101, and a step 200 that may be used to aid in the insertion of the torch pole 101 into the ground. A user may rely on the step 200 for providing a surface on which to press downward with foot pressure or otherwise. The force transferred downwardly to the torch pole 101 via the user using the step 200, and possibly hand pressure on the torch pole 101, will tend to drive the tip 106 (if provided) into the ground followed by the bottom 104 of the torch pole 101 to include all or part of the anchor portion 108. The larger surface area of the step will generally halt the insertion of the pole 101 when it reaches a ground surface. The step 200, upon encountering the ground, both increases the surface are being pushed into the ground and relieves downward pressure into the pole 101. Accordingly, the step 200 may be located sufficiently far from the tip 106 or bottom 104 or the torch pole that the anchor portion 108 is sufficient to provide a stable mount for the torch pole 101 depending upon its length and the weight of the torch 114 or any other accessories to be mounted to the pole 101.

The step 200 may comprise a user deployable step that may be folded downward (as illustrated in FIG. 1) for use in mounting or inserting the torch pole 101 into a ground surface, but may also be folded against the torch pole 101 when not in use or for transport. In various embodiments, the step 200 may be configured to attach to the torch pole 101 and rotate about an axis A. The step 200 may be affixed to the torch pole with a pin or axle 400. The axle 400 may comprise a captive rod, a screw, a bolt, a rivet or another implement allowing the step 200 to be securely affixed to the torch pole 101 while retaining the ability to rotate into a folded and deployed position.

The step 200 may comprise a pair of sidewalls 202, 204 that are spaced apart to define a width of a channel 208. In some embodiments a floor 206 spans between the sidewalls 202, 204 at one side thereof forming a bottom of the channel 208. The sidewalls 202, 204 may be planar and perpendicular to one another while being orthogonal or attached at a right angle relative to the floor 208, which may also be planar. The width of the channel 208 may be such that it can contain the diameter of the torch pole 101 when the step 200 is in a folded position.

In some embodiments, a collar 300 interposes the step 200 and the torch pole 101 such that the collar 300 fits over the torch pole 101 where the axis A passes through, which is where the step 200 affixes to the torch pole 101. Thus, the axle 400 may pass through the step 200, the collar 300, and the torch pole 101. The collar 300 remains generally in place and does not move with respect to the torch 100. Rather the collar 300 provides for additional strength for the torch pole 101 where the step 200 bears on the torch pole 101. The collar 300 may also improve retention of the axle 400 and help to reduce wear or fatigue at this area. In some embodiments, no collar 300 is provided. In further embodiments, no collar 300 is provided but the pole 101 may be thicker, or otherwise strengthened, where the axis A passes through and/or the step 200 affixes to the pole 101.

Referring now to FIG. 2, an exploded perspective for of the torch pole system 100 of FIG. 1 is shown. The collar 300 may slide onto or over the bottom 104 of the torch pole 101. The collar 300 may be aligned with mounting holes 150 that are spaced apart from the bottom 104 of the torch pole 101. The mounting holes 150 may comprise a pair of oppositely spaced holes (e.g., they may be spaced approximately 180° apart on opposite sides of the pole 101). In embodiment where the pole 101 is not hollow at the location of the holes 150, a single hole may be provided all the way through the pole 101. The single hole or pair of holes 150 may be arranged such that the opening through the pole 101 is at a right angle to the major axis of the pole 101 (e.g., along axis A). The collar 300 provides a pair of holes 304 (see, e.g., FIG. 3) that correspond to the pair of holes 150 when the collar is installed onto the pole 101. The step is installed onto the collar 300 and secured via axle 400 to complete assembly of the lower portion of the system 100.

The torch pole system 300 may be useful for installation or mounting of devices apart from torches. Torches may also be replaced or removed if needed. To these ends a mount 152 may be provided at or near the top 112 of the torch pole 101 that can be selectively attached or detached from the torch 100 (FIG. 1) or other device. Clips, screws, brackets or other mounting implements (not shown) may allow securement of the attached device to the mount 162.

Figure 3:
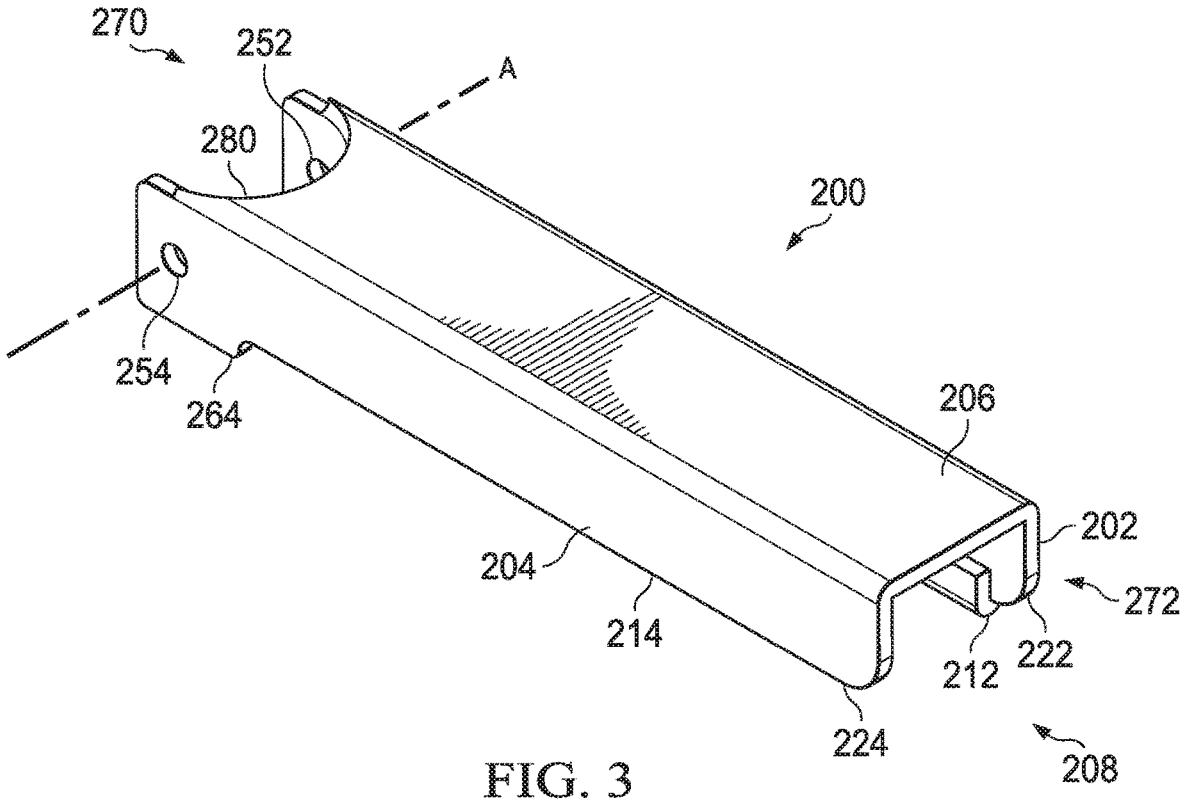
FIG. 3 is an inferior perspective view of a folding step for use with a torch pole according to aspects of the present disclosure.
Figure 4:
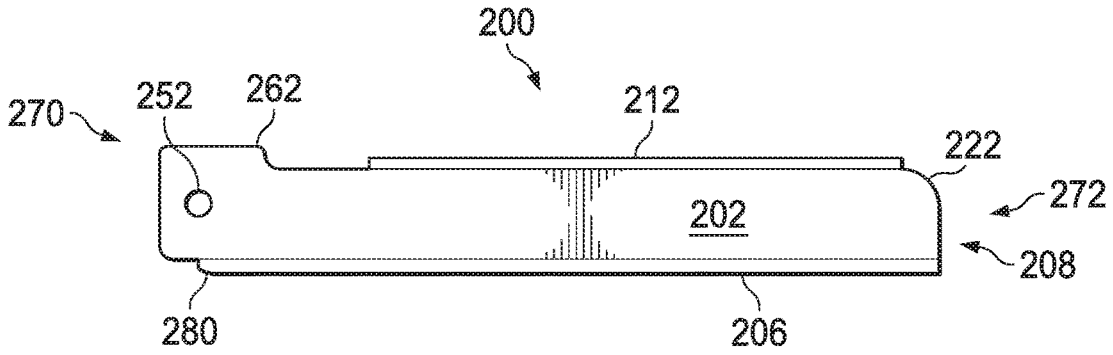
FIG. 4 is a side view of the folding step of FIG. 3.

Referring now to FIG. 3 an inferior perspective view of the step 200 for use with the torch pole system 100 is shown. FIG. 4 is a side view of the step 200 of FIG. 3. Together these additional components and features of the step 200. From the inverted view of FIG. 3, the floor 206 can be seen spanning between what may be referred to at the bottom of the walls 204, 204. A width of the floor 206 or the distance between the walls 202, 204 where they are at right angles to the floor 206 may be slightly larger than a diameter of the pole 101, or the collar 300 if one is present. Thus, the step may attach to the pole 101 and be rotatable about axis A to move into a deployed position or be folded up against the pole 101 wherein the pole 101 is retained within, substantially within, or partially within the channel 208.

A proximal end 270 of the step 200 may be designated as the portion of the step closest to the torch pole 101 when the step 200 is deployed, or otherwise, the portion of the step 200 that affixes to the pole 101. The proximal end 270 of the step 200 provides a pair of axle openings 252, 254 in the sidewalls 202, 204, respectively. The holes or openings 252, 254 may be aligned with axis A when the system 100 is assembled as shown in FIG. 1. Thus, they may align with axis A and be size to receive the axle 400, while retaining the ability for the step 200 to rotate with respect to axis a (e.g., to fold up onto the pole 101). For additional stability, the walls 202, 204 may provide tabs 262, 264, respectively that extend along the major axis of the pole 101 when the step is deployed. The tabs 262, 264 may be extensions of the respective walls that aid in preventing the step 200 from rotating if torque forces are applied (for example, by uneven pressure on the step 200).

The step 200 may be rotatable from essentially vertical (e.g., with respect to an installed and upright pole 101) to a position that is a right angle, or approximately a right angle, to the pole 101. To brace the step 200 and prevent over rotation of the step 200 the step 200 may additionally engage or contact the pole 101 (or collar 300) on cutout 208 on the floor 206. The shape of the cutout 280 may correspond to the shape of the pole 101 or collar 300 which it contacts. As illustrated both the collar 300 and the pole 101 are cylindrical. Thus, they are circular in cross section. The cutout 280 is therefore radiused or cut in the shape of an arc of a circle. The location of holes 252, 254 with respect to the floor 206 in general, and the cutout 280 specifically, may be placed such that the cutout 280 is firmly in contact with the pole 101 or collar 300 when the step has reached a right angle with respect to the pole 101. In such a configuration, the step may be used to apply downward pressure to the pole 101 with a user's foot, for example, and aid in driving the pole 101 into the ground. As discussed, once the step 200 comes into contact with a ground surface or other solid surface, downward movement of the pole 101 may halt. Thus, the anchor portion 108 of the pole 100 may be limited by the location of the step 200.

In order to spread forces applied to the step 200 more evenly with respect to a user's foot, to add strength to the walls 202, 204, and/or to reduce the sharpness of upper edges of the walls 202, 204, widened edges 212, 214 may be provided. The edges 212, 214 may be formed of a folded portion of the respective walls 202, 204 or may be separate components affixed to the top edges of walls 202, 204. The edges 212, 214 may be folded inwards, outwards, or both if comprising a portion of the walls 202, 204. A distance between the opposite edges 212, 214 may remain such that the pole 101 can pass between them when the step 200 is folded. In some embodiments, the entire step 200 is a single piece of steel alloy that is cut and stamped into shape. However, the step 200 could also be formed from separate components that are welded together, for example. A protective coating (e.g., paint, powder coat, or other) may also be applied to the step 200.

Various ends and edges of the step 200 may be radiused to improve appearance or to reduce edge or corner sharpness. As illustrated, the walls 202, 204 have upper radiused edges 222, 224, respectively, at a distal end 272 of the step 200. Similarly, the walls 202, 204 and tabs 262, 264 may have radiused rather than square edges on the proximal end 270 of the step 200.

Figure 5:
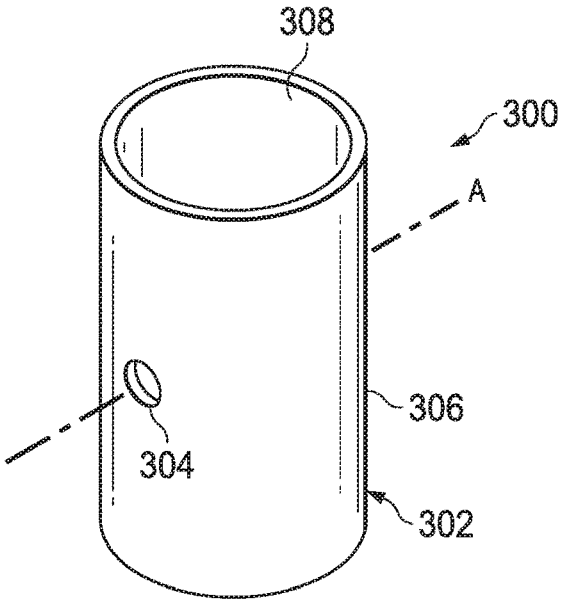
FIG. 5 is a perspective view of a collar for use with a torch pole according to aspects of the present disclosure.

Referring now to FIG. 5, a perspective view of the collar 300 for use with the torch pole system 100 according to aspects of the present disclosure is shown. The collar 300 is not provided in every embodiment. However, when used it may have an inner wall 308 that cooperates with the shape of the pole 101 such that it may be slid onto or otherwise affixed to the pole 101 with little movement once installed. An outer wall 306 may have a shape or contour to cooperate with the shape of the step 200 at the proximal end 270 of the step 200. In some embodiments, this is accomplished with cylindrical inner and outer walls 308, 306 defining a generally cylindrical body 302. A thickness of the body may be chosen so as to add the required or desired amount of strength to the pole 101 where the step 200 affixes and bears against when the pole 101 is inserted into the ground. Collar openings 304 may be provided on spaced apart locations (e.g., 180° apart) to pass the axle 400. The fit of the collar 300 with respect to the pole 101, and the passage through the holes 304 if the axle 400 may hold the collar 300 in place. The collar 300 may comprise stamped, welded, cut, and/or machine metal alloy. It may be provided with a weather resistant coating.

Figure 6:
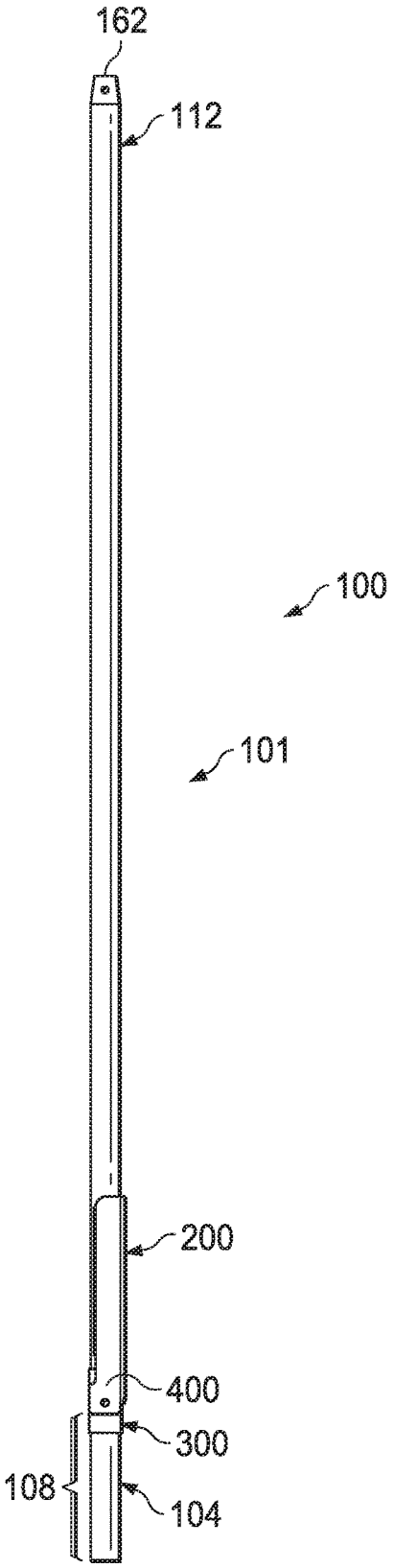
FIG. 6 is a side view of a torch pole system according to the present disclosure with the step folded.

Referring now to FIG. 6, a side view of a torch pole system 100 according to the present disclosure with the step 200 folded is shown. Here it can be seen that, at least in some embodiments, the height of the walls 202, 204 does not substantially exceed the diameter of the pole 300. Distance between the walls 202, 204 may be just sufficient to provide clearance of the pole 101 and/or collar 300 fitting into the channel 208 of the step 200. Thus, the folded step 200 does not take up appreciably more room in storage or shipping than the pole 100 would alone.

Figure 7:
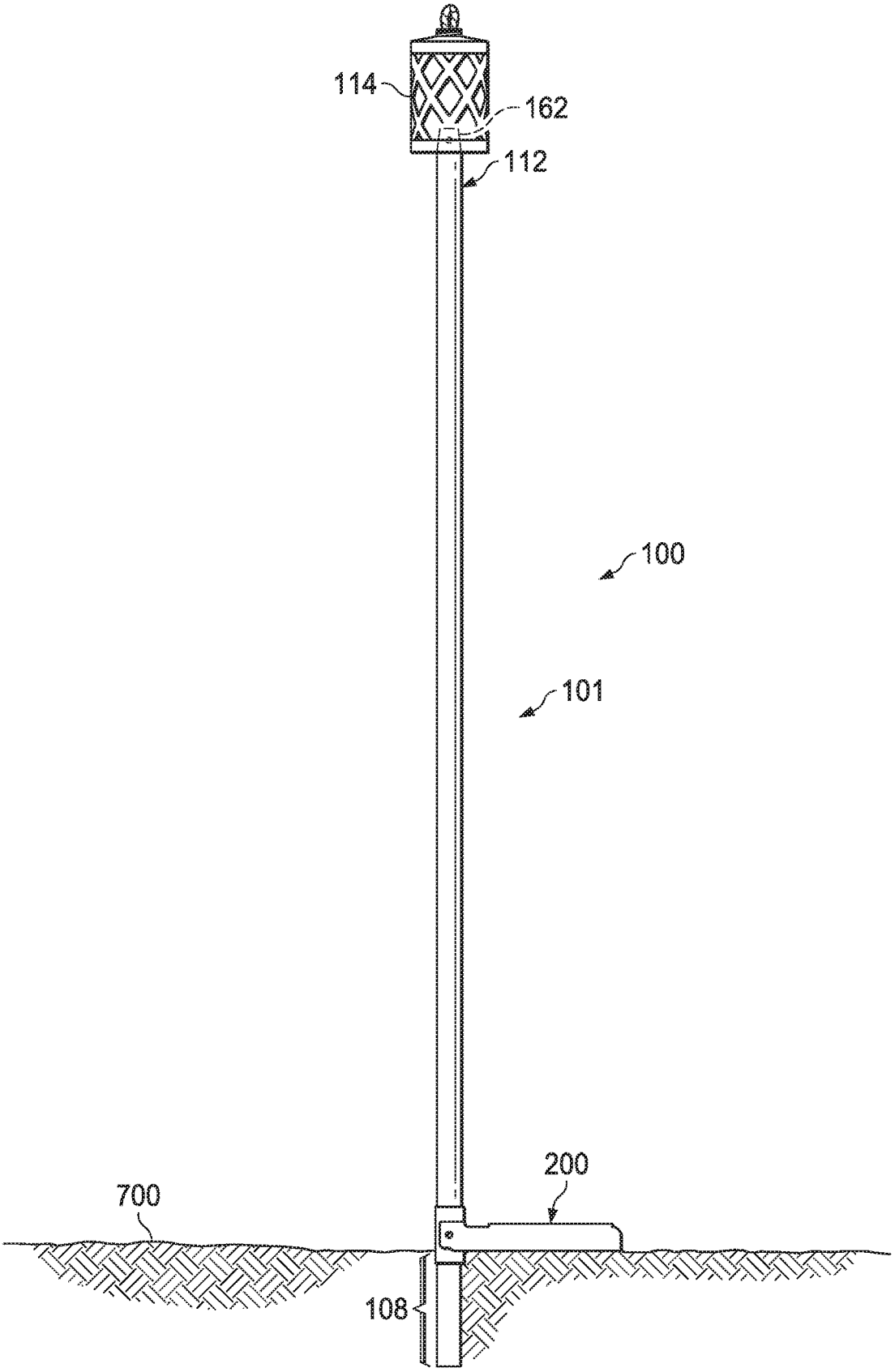
FIG. 7 is a side view of a torch pole system according to the present disclosure installed into a ground surface.

Referring now to FIG. 7, a side view of the torch pole system 100 according to the present disclosure is illustrated installed into a ground surface 700. The step 200 is fully deployed or folded outward from the pole 101 to approximately a right able. A user may grasp an upper or middle portion of the pole 101 to steady or support the pole 101 while a foot is used to press downward on the step 200 driving the pole 101 into the ground 700. The step 200 may be affixed to the pole 101 in such a location that the anchor portion 108 is sufficient to retain the pole 101 in an upright position for use. The step 200 may be folded up after the system 100 is installed if so desired. Overall dimensions of the system 100, and others of the present disclosure, may vary. In one particular example, the step 200 may be about 5 inches in total length. As shown, the step 200 provides about 4.31 inches of stepable length. This provides adequate area for the foot, and shoe, of all or most customers, while preventing excessive torque that may make installation difficult and/or potentially damage components.

Figure 8:
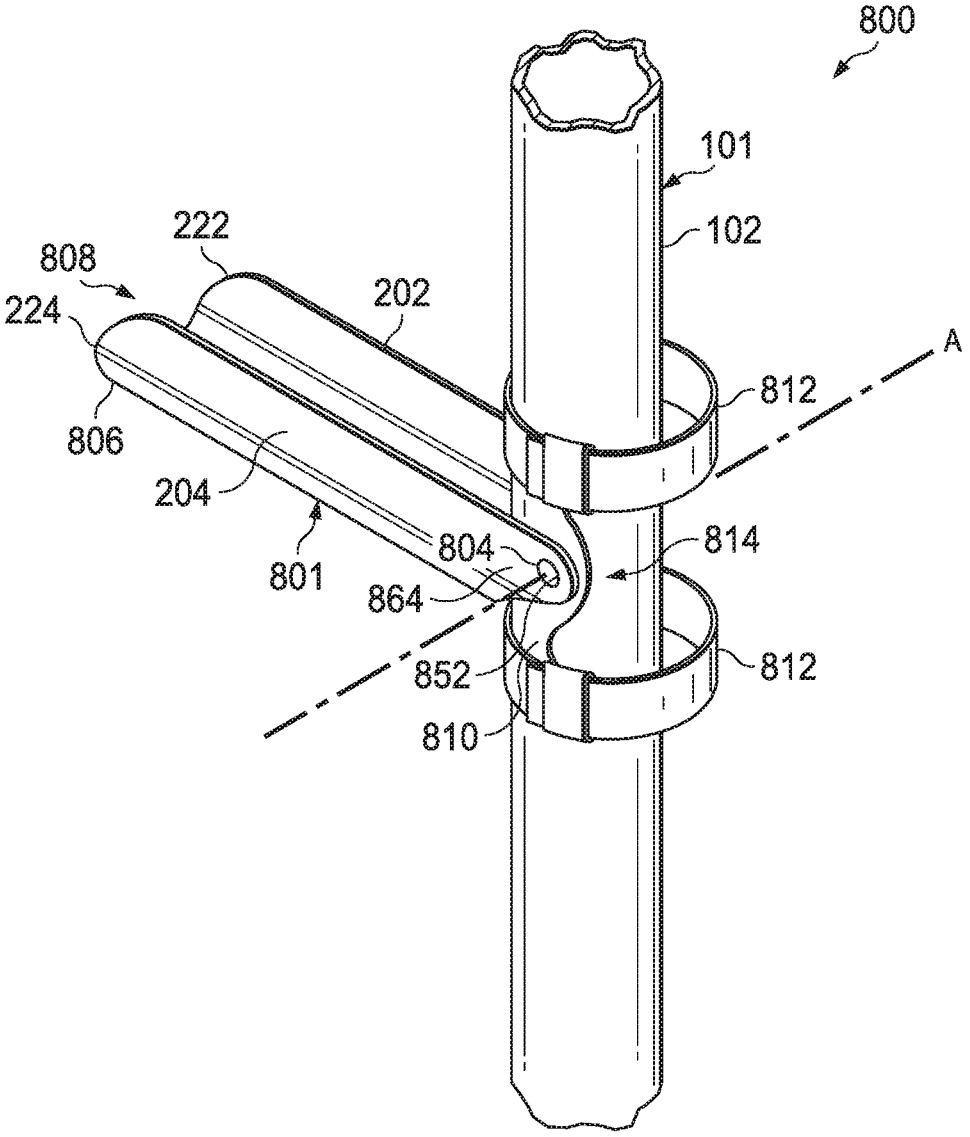
FIG. 8 is a closeup perspective view of another embodiment of a torch pole system according to aspects of the present disclosure.

Referring now to FIG. 8, a closeup perspective view of another embodiment of a torch pole system 800 according to aspects of the present disclosure is shown. The torch pole system 800 may be based upon a torch pole 101 comprising bamboo or another wood based organic material. Only the lower pole segment 102 is shown here but the other components of the pole 101 may be present as well, and may comprise the same or a different material as segment 102. Similarly, various points, caps, or other devises may be utilized with the anchor portion 108 as well as various implements for attaching or detaching torches or other items.

The torch pole system 800 comprises a step 801 that may fold for storage and/or shipping as with previous embodiments. The step 200 comprises opposite walls 202, 204 that are spaced apart, and may be planar, or comprise planar portions. As with previous embodiments, the walls 202, 204 may include radiused edges 222, 224, respectively, at the upper distal ends thereof. Tops of the walls 202, 204 may be folded or have widened edges (e.g., similar to torch pole system 100 above). The walls 202, 204 may define a channel 808 between them that receives the lower torch pole segment 102 to which the step 801 is mounted when the step 801 is folded. The walls 202, 204 may have a floor 806 spanning between them, possibly on a lower portion thereof. The floor 806 may be curved and may have a curvature that conforms to the outer surface of the pole segment 102 for compact storage or other purposes.

Figure 9:
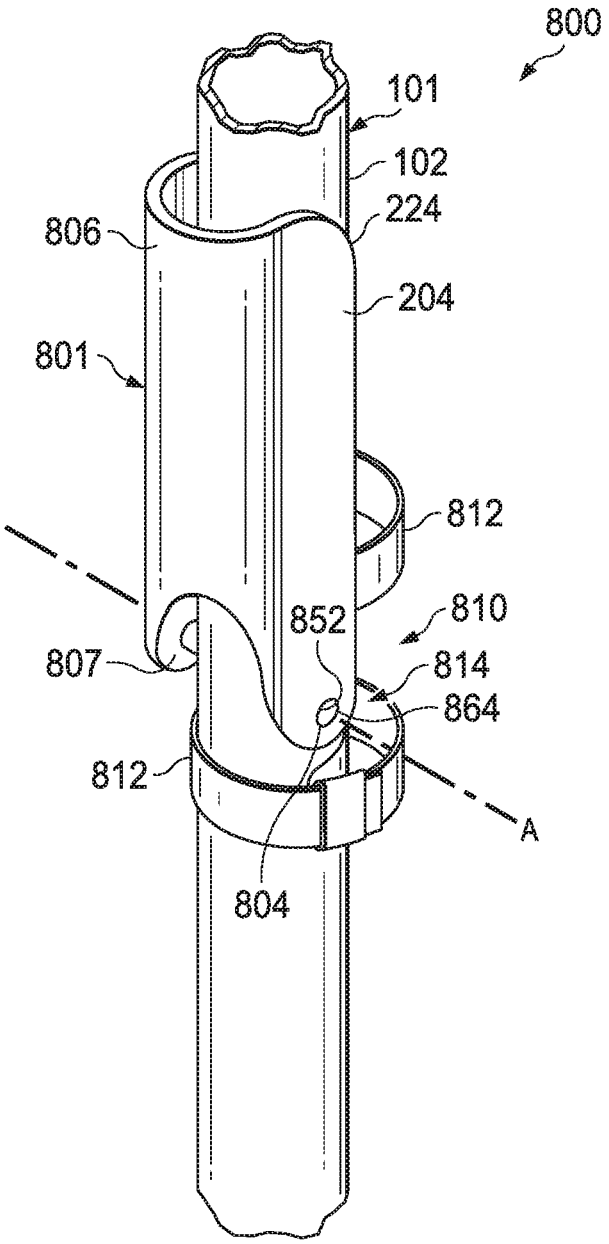
FIG. 9 is a closeup perspective view of the torch pole system of FIG. 8 in a folded configuration.

The step 801 may attach to a mount 810 to rotate about axis A to move from a deployed position (as shown in FIG. 8) to a folded position (e.g., FIG. 9). Axis A may be through the center of the pole 101, or near thereto, and may be at a right angle to the pole 101. The mount 810 may be curved to confirm to the outer surface of the pole 101. In some cases, the mount 810 forms a portion of a cylinder. In some embodiments, spaced apart from the axis A are band clamps 812 which fix the mount 810 to the pole 101. The clamps 812 may comprise ratcheting mechanisms for securement to the pole 101. The clamps 812 may not be removable once firmly clamped to the pole. In other embodiments a release mechanism (not shown) may be provided or adjustable screw clamps may be used.

An offset 814 may be provided on the mount 810 on opposite sides of the pole 101 (e.g., along axis A). This may allow for a fastener 804 to be provided on each side that secures the step 801. The fastener 804 may comprise a brad or rivet, for example. One fastener may be provided on each side of the pole 101 (e.g., at each offset 814). The walls 202, 204 may each provide an ear 864 through which the respective fastener 804 affixes. The fastener 804 (one on each side of the pole) allows the step 801 to rotate as described. it should be appreciated that, in the illustrated configuration, the pole 101 does not have to be drilled through to mount the step 801 and thus some additional integrity of the pole 101 may be retained (particularly where the pole is bamboo, for example).

Referring now to FIG. 9 is a closeup perspective view of the torch pole system 800 is shown in a folded configuration. Here, the floor 806 may also be seen to define a cutout 807 on the proximal end thereof. The cutout 807 may define a radius similar or identical to that of the mount 810 where the floor 806 bears against the mount 810. The floor 806 may form a continuous curve with the walls 202, 204. Thus, the cutout 807 may be partially defined by the walls 202, 204. The walls 202, 204 and/or floor 806 of the step 801 bear on the mount 810 when the step is utilized for installing the system 800. The mount 810 and bands 812 transfer this force to the pole 801 for aid in insertion into the ground, similar to the system 100 discussed above.

Figure 10:
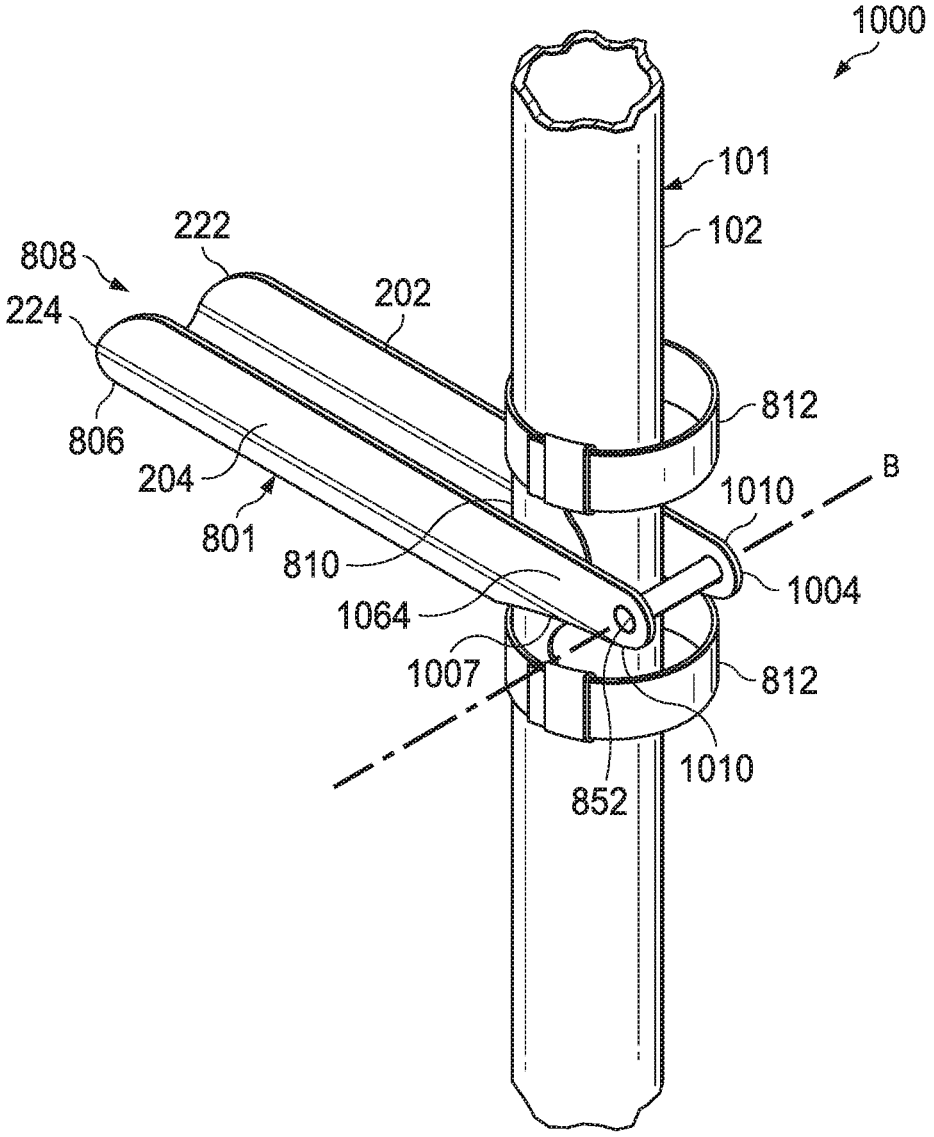
FIG. 10 is a closeup perspective view of another embodiment of a torch pole system according to aspects of the present disclosure.

Referring now to FIG. 10 is a closeup perspective view of another embodiment of a torch pole system 1000 according to aspects of the present disclosure is shown. The system 1000 is similar to the system 800 in that it is suitable for use with a bamboo, wooden, or other organic based torch pole 101. However, these systems may also be utilized with a metallic, polymer, or other pole construction. The system 1000 does not require drilling into the pole 101 and comprises a pair of spaced apart walls 202, 204 and a possibly curved floor 806 defining a channel 808 within the step 801. Here, however, ears 1064 of the walls 202, 204 are extended further than the ears 864 of the system 800 so as to reach to an opposite side of the pole 101 from the floor 806 of the step 801. The extension of the ears 1064 to allows the step 801 to rotate about axis B, which is offset from the pole 101.

The illustrated configuration of the system 1000 may negate the need for the offsets 814 (FIG. 8). The mount 810 may provide one or a pair of extensions 1010 that receive a fastener 1004 that is also received by the ears 1064 of each of the walls 202, 204. The fastener 1004 may comprise a rivet, bolt, or another component serving as an axle for the rotation of the step 801. In other embodiment a separate fastener may be used on each side of the step 801 (e.g., for each wall 202, 204). Here again, the floor 806 and/or walls 202, 204 may define a cutout 1007 that bears on the mount 810 when the step 801 is folded down.

Figure 11:
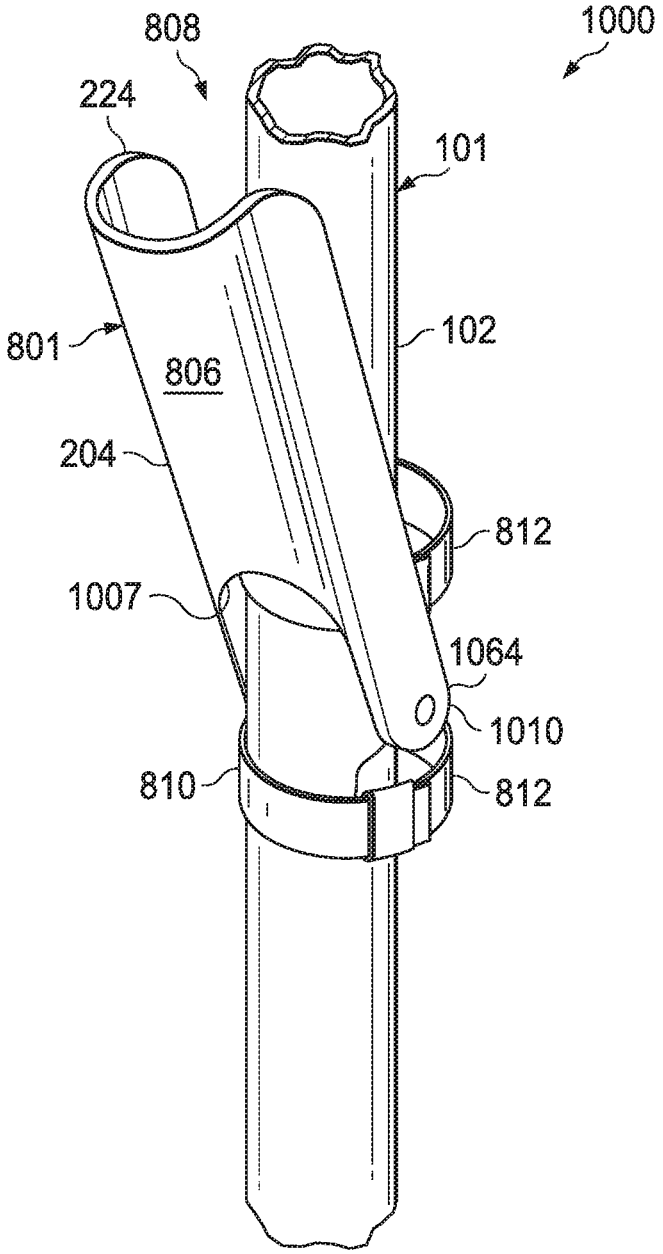
FIG. 11 is another closeup perspective view of the torch pole system of FIG. 10 in a folded configuration.

Referring now to FIG. 11, another closeup perspective view of the torch pole system 1000 is shown in a folded configuration. Although the pole 101 may fit into the channel 808, since the axis B may be offset from the pole 101, the geometric limitations of the system 1000 may not allow for the step 801 to fit flush to the pole 101. An interference fit between the ears 1064 and one of the bands 812 may hold the step 801 in the upright position. In some embodiments, the mount 810 may be removed from the pole 101 for stowage of the step 801. When the cutout 1007 allows, the step 801 may be rotated completely about the mount 810 and the mount 810 reinstalled with the step 801 on the same side of the pole 101 as the bands 812.

Figure 12:
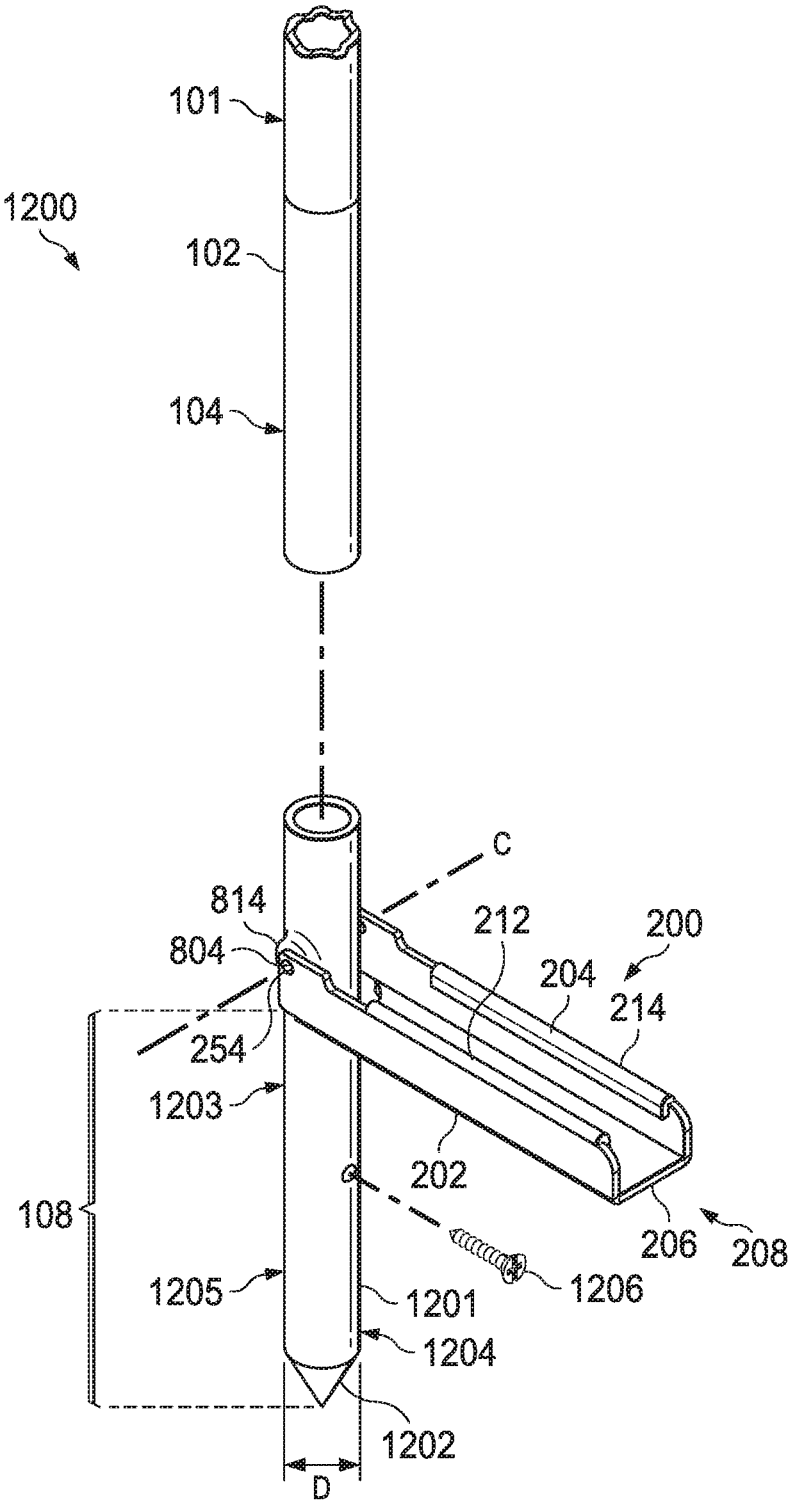
FIG. 12 is close up perspective view of a lower portion of another torch pole system according to aspects of the present disclosure.

Referring now to FIG. 12, a close-up perspective view of a lower portion of another torch pole system 1200 according to aspects of the present disclosure is shown. The torch pole system 1200 may have similarities with respect to the embodiments previously discussed in that it utilizes a torch pole 101 that may be a single component or have multiple joinable segments. For illustrative purposes only the lower bottom 104 of the pole 101 is shown. The present embodiment 1200 may be utilized with torch poles of any constriction but it may be particularly useful where the pole 101 is likely to break or splinter if inserted into the ground on its own, or where the force of the step 200 is likely to damage the pole 101.

The system 1200 includes a receptacle or sleeve 1201 that receives and/or covers the bottom 104 of the pole 102. The sleeve 1201 may be generally in the shape of a hollow cylinder and provides strength and/or protection to the bottom 104 of the pole 102. The sleeve 1201 may have a distal end 1204 and a proximal end 1203, where the pole 102 is received. The sleeve 1201 may provide a fastener or screw 1206 or other implement for preventing unwanted withdrawal of the pole 102 from the sleeve 1201. The screw 1206 is shown on a medial portion 1205 of the sleeve 1201, but in other embodiments it may be located elsewhere, such as at the proximal end 1203, even possibly at or above the location of the step 200.

The sleeve 1201 also provides a mounting location for the step 200, which may be at or near the proximal end 1203 of the sleeve 1201. The step 200 may be configured as described above. In other embodiments a step 801 as described above may be used. Any cutout 280, 807 on the respective step 200, 801 may bear against the sleeve 1201.

The step utilized (200 as shown) may fold about a hinge axis C for storage and deployment. The axis C may be through or nearly through the center of a diameter D of the sleeve 1201 (and therefore a diameter of the bottom 104 of pole 101). In other embodiments the axis C is nearer one side or the other of the sleeve 1201 (e.g., close to or further from the step 200).

Where the axis C is spaced apart from a central point of the diameter D of the sleeve 1201 extensions (e.g., 1010, FIG. 10) may be provided from the sleeve 1201 to receive one or more fasteners (e.g., 400, 804, 1004) that affix the step 200 to the sleeve 1201. Where the axis C is more centrally located in the diameter D, offsets 804 may be provided by the sleeve 1201 for receiving the fasteners 804 (e.g., one faster 804 and offset 814 per side).

The pole 101 may still be received into the channel 208 of the step 200 when the step 200 is folded upward. When folded downward, the step 200 bears against the sleeve 1201 (which may be thicker at this point) for insertion of the pole 101 into the ground. The sleeve 1201 may provide a sharped tip or point 1202 for ease of insertion. The step 202, being mounted on the sleeve 1201, may define the anchor portion 108 of the system 1200. Here, the anchor portion 108 may be entirely on the sleeve 108 and defined between the location of the step 200 on the sleeve 1201 and the point 1202 of the sleeve 1201 if so provided (otherwise, the anchor point 108 may be considered to terminate at the distal end 1204 of the sleeve 1201 spaced apart and opposite from the step 1201, which may be at or near the proximal end 1203).

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A torch pole assembly comprising:

a torch pole having a top, a bottom, and a length between the top and bottom;

an opening passing through the torch pole transverse to its length;

a collar receiving the torch pole and having a pair of collar openings on opposite sides of the collar and arranged to be on a common axis with the opening through the torch pole;

a step comprising a pair of spaced apart sidewalls, each defining a sidewall opening situated on the common axis, and a floor spanning between the sidewalls and spaced apart from the sidewall openings; and an axle occupying the common axis and passing through the pair of sidewall openings, the pair of collar openings, and the torch pole opening;

wherein the step is rotatable from a parallel position in which the floor is parallel to the length of the torch pole, to a perpendicular position in which the floor is perpendicular to the length of the torch pole, the step floor defining a cutout proximate the collar that receives and contacts the collar when the step is in the perpendicular position thereby preventing the step from rotation beyond the perpendicular position.

2. The torch pole assembly of claim 1, wherein the floor of the step is at a bottom of the spaced apart sidewalls when the step is in the perpendicular position.

3. The torch pole assembly of claim 2, wherein the spaced apart sidewalls provide widened upper edges opposite the floor that have a width greater than a width of the spaced apart sidewalls where each joins the floor.

4. The torch pole assembly of claim 1, wherein the torch pole is received into a channel defined by the spaced apart walls and the floor when the step is in the parallel position.

5. The torch pole assembly of claim 4, wherein the step is proximate the bottom of the torch pole and spaced apart from the top of the torch pole.

6. The torch pole assembly of claim 5, wherein the bottom of the torch pole provides a pointed end.

7. The torch pole assembly of claim 6, wherein the torch pole comprises multiple pole segments.

8. The torch pole assembly of claim 1, wherein the torch pole is hollow.

9. The torch pole assembly of claim 8, wherein the axle comprises a rivet.

10. The torch pole assembly of claim 8, wherein the axle is removable.

11. A torch pole assembly comprising:

a torch pole having a top, a bottom, and a length between the top and bottom;

an opening passing through the torch pole transverse to its length;

a step comprising a pair of spaced apart sidewalls, each defining a sidewall opening situated on the common axis, and a floor spanning between the sidewalls and spaced apart from the sidewall openings; and an axle occupying the common axis and passing through the pair of sidewall openings and the torch pole opening;

wherein the step is rotatable from a parallel position in which the floor is parallel to the length of the torch pole, to a perpendicular position in which the floor is perpendicular to the length of the torch pole, the step floor defining a cutout proximate the collar that receives and contacts the collar when the step is in the perpendicular position thereby preventing the step from rotation beyond the perpendicular position.

12. The torch pole assembly of claim 11, wherein the cutout comprises an arc of a circle.

13. The torch pole assembly of claim 12, further comprising a collar receiving the torch pole and interposing the torch pole and the step, and further having a pair of collar openings on opposite sides of the collar and arranged to be on a common axis with the opening through the torch pole.

14. The torch pole assembly of claim 12, wherein the floor of the step is along a bottom of the pair of spaced apart sidewalls when the step is in the perpendicular position and each of the pair of spaced apart sidewalls terminates in a widened edge at the top thereof, opposite the floor.

15. The torch pole assembly of claim 14, wherein the step is proximate the bottom of the torch pole and spaced apart from the top of the torch pole and defines an anchor portion of the pole between the step and the bottom of the torch pole.

16. The torch assembly of claim 15, wherein the anchor portion terminates in a pointed end at the bottom of the torch pole.

17. The torch assembly of claim 16, further comprising a mount for receiving a torch at the top of the torch pole.

18. A torch pole assembly comprising:

a pole having an upper end, a bottom end, and a length therebetween;

a step having a channel defined between a pair of sidewalls and bounded on a bottom side by a floor spanning between the sidewalls;

wherein the step is affixed with respect to the pole on an axis and is moveable on the axis from a first position in which the pole is within the channel and a second position in which the floor is at a right angle to the pole and prevents further movement of the step on the axle.

19. The torch pole assembly of claim 18, further comprising a collar received onto the pole at a location of the axis, the collar interposing the axle and the floor of the step when the step is in the second position.

20. The torch pole assembly of claim 19, wherein the pole and the axle form a pair of nested cylinders at the location of the axis and the floor receives the collar into a radiused cutout when the step is in the second position.

21. The torch pole assembly of claim 18, further comprising a sleeve that receives the torch pole and affixes the step in position with respect to the pole.

* * * * *